US012429292B2

(12) United States Patent
Xiang et al.

(10) Patent No.: US 12,429,292 B2
(45) Date of Patent: Sep. 30, 2025

(54) FIN STRUCTURE AND HEAT EXCHANGER

(71) Applicant: Gree Electric Appliances, Inc. of Zhuhai, Guangdong (CN)

(72) Inventors: Wu Xiang, Guangdong (CN); Quyang Ma, Guangdong (CN); Ge Yu, Guangdong (CN); Kai Xia, Guangdong (CN); Weixue Lin, Guangdong (CN); Shiqiang Zhang, Guangdong (CN)

(73) Assignee: Gree Electric Appliances, Inc. of Zhuhai, Guangdong (CN)

( * ) Notice: Subject to any disclaimer, the term of this patent is extended or adjusted under 35 U.S.C. 154(b) by 370 days.

(21) Appl. No.: 17/910,597

(22) PCT Filed: Mar. 5, 2021

(86) PCT No.: PCT/CN2021/079352
§ 371 (c)(1),
(2) Date: Sep. 9, 2022

(87) PCT Pub. No.: WO2021/258775
PCT Pub. Date: Dec. 30, 2021

(65) Prior Publication Data

US 2023/0136711 A1 May 4, 2023

(30) Foreign Application Priority Data

Jun. 24, 2020 (CN) ..... 202010588660.1

(51) Int. Cl.
*F28F 1/32* (2006.01)

(52) U.S. Cl.
CPC ..... *F28F 1/32* (2013.01); *F28F 2215/10* (2013.01)

(58) Field of Classification Search
CPC ..... F28F 1/32; F28F 1/325; F28F 1/10
See application file for complete search history.

(56) References Cited

U.S. PATENT DOCUMENTS 3,645,330 A 2/1972 Albright et al.
4,923,002 A 5/1990 Haussmann
(Continued)

FOREIGN PATENT DOCUMENTS

CH 160856 A * 3/1933
CN 203231680 U 10/2013
(Continued)

OTHER PUBLICATIONS

CN 202110853451.X, First Examination Report Notification, Dec. 29, 2024.

*Primary Examiner* — Eric S Ruppert
(74) *Attorney, Agent, or Firm* — The Webb Law Firm

(57) ABSTRACT

Provided is a fin tube heat exchanger in which multiple stacked fins are formed into a particular shape so as to make the air flow between the fins smoother and which exhibits excellent heat transfer performance by increasing the ridge lines that are the lines of intersection between surfaces in order to enhance the heat transfer performance between the fins and the air flow. A fin tube heat exchanger wherein: stacked heat-transfer fins each have a wedge-shaped dent (80) on the upstream wind side and the downstream wind side of a fin collar (60); the dent (80) is configured from a first ridge line (80*a*) extending in the column direction in the upstream wind side and downstream wind side of the fin collar (60), and two second ridge lines (80*b*) which are arranged in the shape of a V and which derive from the vertex (P) of the first ridge line (80*a*) and a ridge line (40*b*) on the valley side extending in the step direction; and two V-shaped slanted planes are formed by means of the first ridge line (80*a*) and the second ridge lines (80*b*).

14 Claims, 6 Drawing Sheets

(56) References Cited

U.S. PATENT DOCUMENTS

| | | | |
|---|---|---|---|
| 6,349,761 | B1 | 2/2002 | Liu et al. |
| 2003/0000686 | A1 | 1/2003 | Kester |
| 2005/0274503 | A1 | 12/2005 | Gong et al. |

FOREIGN PATENT DOCUMENTS

| | | | |
|---|---|---|---|
| CN | 104089518 | A | 10/2014 |
| CN | 104110987 | A | 10/2014 |
| CN | 104142085 | A | 11/2014 |
| CN | 105190216 | A | 12/2015 |
| CN | 106052462 | A | 10/2016 |
| CN | 106610244 | A | 5/2017 |
| CN | 106610245 | A | 5/2017 |
| CN | 206222998 | A | 6/2017 |
| CN | 109163596 | A | 1/2019 |
| CN | 109737791 | A | 5/2019 |
| CN | 109737792 | A | 5/2019 |
| CN | 209558991 | A | 10/2019 |
| CN | 110726325 | A | 1/2020 |
| CN | 111023865 | A | 4/2020 |
| CN | 110207530 | B | 6/2020 |
| CN | 112066776 | A | 12/2020 |
| CN | 215676621 | U | 1/2022 |
| EP | 1498681 | A1 | 1/2005 |
| EP | 3018439 | A2 | 5/2016 |
| JP | S55171887 | U | 12/1980 |
| JP | S5761375 | U | 4/1982 |
| JP | H07280479 | A | 10/1995 |
| JP | H11125495 | A | 5/1999 |
| KR | 20110083016 | A1 * | 7/2001 |
| WO | 2013001744 | A1 | 1/2013 |
| WO | 2020080862 | A1 | 4/2020 |

* cited by examiner

Fin structure of prior art

Fin structure of the present invention

Fin structure of prior art

Fin structure of the present invention

Fin structure of prior art

Fin structure of the present invention

FIN STRUCTURE AND HEAT EXCHANGER

CROSS-REFERENCE TO RELATED APPLICATION

The present application is a U.S. National Stage Application of International Patent Application No. PCT/CN2021/079352, filed on Mar. 5, 2021, which claims priority to Chinese Patent Application No. 202010588660.1 filed on Jun. 24, 2020, the disclosures of which are hereby incorporated by reference in their entireties.

BACKGROUND OF THE INVENTION

Field of the Invention

The present application relates to the technical field of refrigeration devices, and in particular, to a fin structure and a heat exchanger.

Description of Related Art

In prior art, fin tube heat exchangers are widely used in chemical, ventilation, heating, air conditioning, refrigeration and other industries due to characteristics such as simple manufacture and strong applicability, and how to maximally transfer heat and utilize thermal energy (enhancing heat transfer) has always been the focus of research in the industry.

Fin structures of the fin tube heat exchanger mainly include straight fins, corrugated fins and corresponding slotted (windowed) structures, etc. For the traditional straight fins and corrugated fins, the leeward side of a heat exchange tube often has poor heat exchange, and the corresponding slotted structures increase the contact area on an air side, and at the same time, the structure irregularity disturbs a flow field, which enhances the mixing between fluids and delays flow separation of a boundary layer, thereby enhancing the overall heat exchange performance. However, since the slotted structure usually decreases a flow gap and increases a flow resistance of the fin, the fin is easily blocked by frost under wet conditions, the service life of the fin is shortened, and at the same time, the effective heat exchange area is reduced, which affects an actual heat exchange effect of the fin. Comprehensively considering a resistance, the heat transfer performance and processability, the corrugated fins are in a form that is more suitable for industrial applications. However, with further improved requirements on heat dissipation of the heat exchangers, it is difficult for the traditional corrugated fins to meet the performance requirements of high-efficiency heat exchangers.

SUMMARY OF THE INVENTION

Embodiments of the present application provide a fin structure and a heat exchanger, so as to improve a heat exchange effect of the fin and enhance a heat exchange performance of the heat exchanger.

In order to achieve the above purpose, the present application provides a fin structure, including: a fin base, wherein the fin base is provided with a tube hole for a heat exchange tube passing though, and the fin base is a corrugated fin; and a plurality of convex parts, wherein the convex part is disposed on the fin base, and the plurality of convex parts surround an outer circumference of the tube hole.

Further, the fin base includes a plurality of first plates and a plurality of second plates, the second plate is connected between two first plates, and a corresponding node length L1 of the first plate is greater than a corresponding node length L2 of the second plate.

Further, there are two second plates between two first plates, and the two second plates are disposed adjacently.

Further, a ratio h1/S of a corrugation height h1 of the fin base to a fin spacing S is 0.58~0.62, and L1/L2 is 1.5~1.7.

Further, the plurality of convex parts include: an annular convex part, the annular convex part being convexly disposed on the first plate; and a lateral convex part, the lateral convex part being convexly disposed on the second plate.

Further, the annular convex part is an annular convex structure, a plurality of the annular convex parts are disposed, and the plurality of the annular convex parts are symmetrically distributed on the outer circumference of the tube hole.

Further, the lateral convex part is a boss, a plurality of the lateral convex parts are disposed, and the plurality of the lateral convex parts are symmetrically distributed on the outer circumference of the tube hole.

Further, a ratio h3/S of a raised height h3 of the annular convex part to the fin spacing S is 0.35~0.4.

Further, a ratio h2/S of a raised height h2 of the lateral convex part to the fin spacing S is 0.35~0.4.

Further, the fin base is provided with an annular groove, wherein the tube hole is located in the annular groove, the annular groove and the tube hole are concentrically disposed, an outer circumference of the annular groove is connected to the first plate and the second plate, and the convex parts are all located outside the annular groove.

Further, there are two second plates between two first plates, the two second plates are disposed adjacently, and a wave trough line is formed on which the two second plates intersect; and two arc-shaped surfaces symmetrical with respect to the tube hole are formed at joints between the annular groove and the two first plates, and four planes symmetrical with respect to the tube hole are formed at joints between the annular groove and the two second plates.

Further, a groove bottom of the annular groove is tangent to the wave trough line in a vertical incoming flow direction; and an included angle θ between a generatrix of the arc-shaped surface and a central axis of the heat exchange tube is 45°.

Further, a ratio d1/D of a diameter d1 of the groove bottom of the annular groove to an outer diameter D of the heat exchange tube is 1.6~1.7.

Further, the two first plates are symmetrically disposed with respect to the tube hole, and the two second plates are symmetrically disposed with respect to the tube hole.

Further, a ratio D1/D of an inner diameter D1 of the tube hole to an outer diameter D of the heat exchange tube is 1.025~1.035.

According to another aspect of the present application, a heat exchanger is provided, the heat exchanger including the above fin structure.

The structure of the corrugated fin is improved in the present application by disposing the plurality of convex parts on the outer circumference of the tube hole. The convex parts play a role of enhancing airflow disturbance nearby the tube hole (installed heat exchanger), so that a flow rate of a local area is increased, a mixing of cold and hot fluids is enhanced, and an effective heat exchange area of the fin is increased, thereby enhancing a heat exchange performance of a heat exchanger. Compared with the windowed fin, the fin structure according to the present application is less likely to form frost on a fin surface under wet conditions, thereby effectively reducing the occurrence of blockage of a flow channel. Compared with the ordinary corrugated fins, the fin structure according to the present application effectively increases the heat exchange area, thereby further improving the heat exchange effect.

DESCRIPTION OF THE INVENTION

The present application will be described in further detail below in combination with the accompanying drawings and specific embodiments, which are not intended to limit the present application.

Referring to FIG. 1 to FIG. 4, according to embodiments of the present application, a fin structure is provided. The fin structure includes a fin base 10 and a plurality of convex parts 30. The fin base 10 is provided with a tube hole 20 for a heat exchange tube passing through, and the fin base 10 is a corrugated fin. The convex part is disposed on the fin base 10, and the plurality of convex parts 30 surround an outer circumference of the tube hole 20.

The structure of the corrugated fin is improved in the present application by disposing the plurality of convex parts 30 on the outer circumference of the tube hole. The convex parts 30 play a role of enhancing airflow disturbance nearby the tube hole (installed heat exchanger), so that a flow rate of a local area is increased, a mixing of cold and hot fluids is enhanced, and an effective heat exchange area of the fin is increased, thereby enhancing a heat exchange performance of a heat exchanger. Compared with the windowed fin, the fin structure according to the present application is less likely to form frost on a fin surface under wet conditions, thereby effectively reducing the occurrence of blockage of a flow channel. Compared with the ordinary corrugated fins, the fin structure according to the present application effectively increases the heat exchange area, thereby further improving the heat exchange effect.

Figure 1:
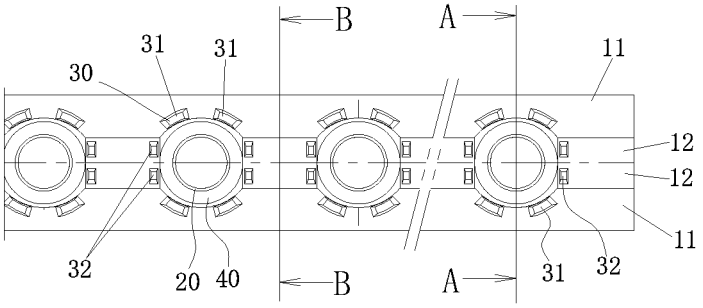
FIG. 1 is a schematic plan view of a fin structure according to an embodiment of the present application.
Figure 2:
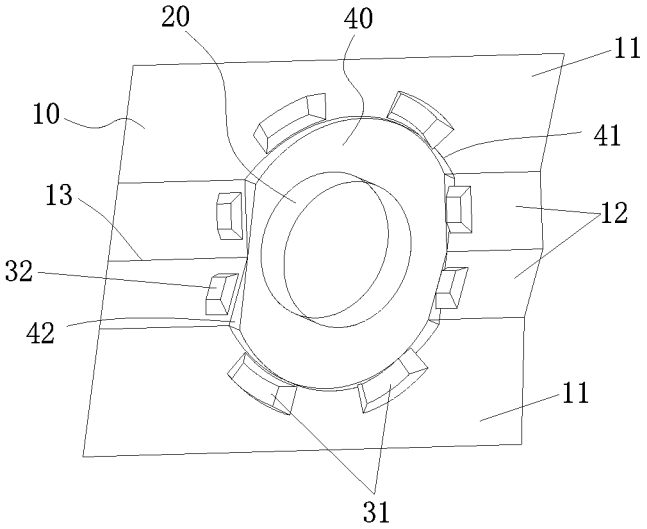
FIG. 2 is a schematic three-dimensional structural diagram of a fin structure according to an embodiment of the present application.
Figure 3:
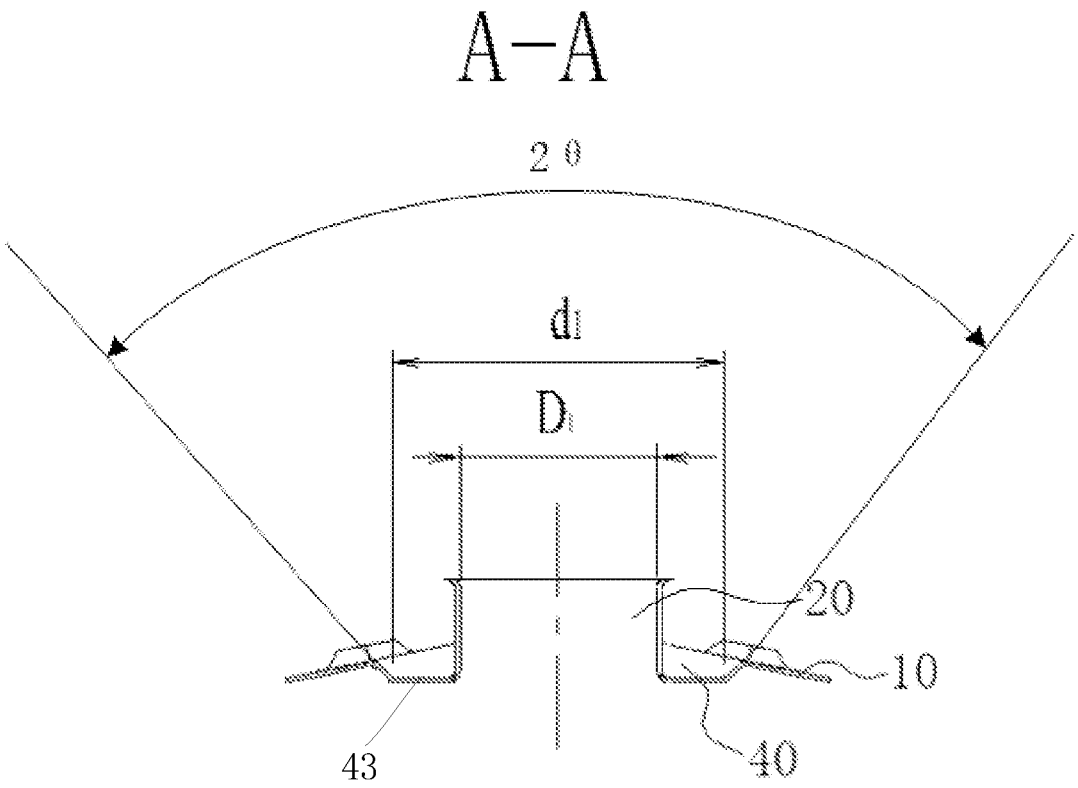
FIG. 3 is an A-A sectional view of the fin structure of FIG. 1.
Figure 4:
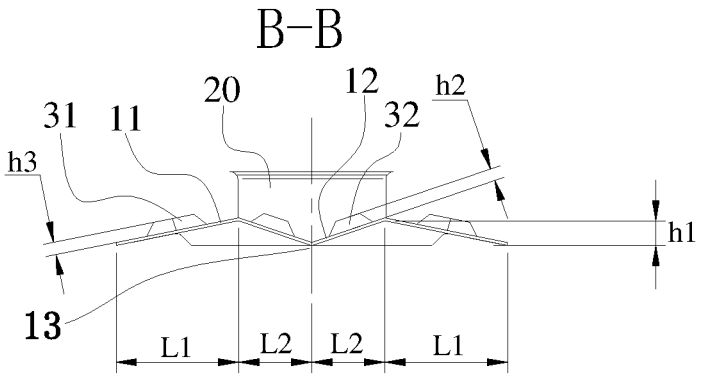
FIG. 4 is a B-B sectional view of the fin structure of FIG. 1.

In combination with FIG. 1 and FIG. 2, the fin base 10 includes a plurality of first plates 11 and a plurality of second plates 12, the second plate 12 is connected between two first plates 11, and a corresponding node length L1 of the first plate 11 is greater than a corresponding node length L2 of the second plate 12. That is to say, a surface of the fin base 10 is divided into large plates and a small plate, which are the first plates and the second plate respectively and expanded in an M shape along an airflow direction. The "plurality" herein refers to two or more.

There are two second plates 12 between two first plates 11, and the two second plates 12 are disposed adjacent to each other. In some embodiments, the two first plates 11 are disposed symmetrically with respect to the tube hole 20, the two second plates 12 are disposed symmetrically with respect to the tube hole 20, and a wave trough line is formed on which the two second plates 12 intersect. To the fin base 10 of the present embodiment, such structural arrangement of the first plates 11 and the second plates 12 makes the whole fin surface is expanded in the M shape along the airflow direction.

In some embodiments, a ratio h1/S of a corrugation height h1 of the fin base 10 to a fin spacing S is 0.58~0.62, and L1/L2 is 1.5~1.7. Based on such relationship between the corrugation height and the fin spacing, as well as such relationship between the corresponding node length L1 of the first plate 11 and the corresponding node length L2 of the second plate 12, a heat exchange capacity of the fin itself is improved.

Referring to FIG. 2, the plurality of convex parts 30 include an annular convex part 31 and a lateral convex part 32. The annular convex part 31 is convexly disposed on the first plate 11; the lateral convex part 32 is convexly disposed on the second plate 12. The annular convex part 31 and the lateral convex part 32 both enhance fluid disturbance, and they are disposed on different plates, thereby delaying a phenomenon of flow separation of a boundary layer and improving the heat exchange performance of the fin.

The annular convex part 31 is an annular convex structure, a plurality of the annular convex parts 31 are disposed, and the plurality of the annular convex parts 31 are symmetrically distributed on the outer circumference of the tube hole 20. In the present embodiment, the plurality of the annular convex parts 31 are four segments of annular convex parts symmetrically disposed on the first plates 11.

The lateral convex part 32 is a boss, a plurality of the lateral convex parts 32 are disposed, and the plurality of the lateral convex parts 32 are symmetrically distributed on the outer circumference of the tube hole 20. The plurality of the lateral convex parts 32 are four segments of square bosses symmetrically disposed on the second plates 12. The lateral convex parts 32 have a shape of a rectangular block. Due to the arrangement of the lateral convex parts 32 and the annular convex parts 31, the airflow disturbance nearby the heat exchange tube is enhanced, so that the flow rate in the local area is improved, the mixing of hot and cold fluids is enhanced, and a thickness of the boundary layer is reduced, thereby significantly reducing a wake area behind the tube, and increasing the effective heat exchange area of the fin.

In order to consider a balanced relationship between the airflow and a height of the annular convex part 31, a ratio h3/S of a raised height h3 of the annular convex part 31 to the fin spacing S is 0.35~0.4.

In order to consider a balanced relationship between the airflow and a height of the lateral convex part 32, a ratio h2/S of a raised height h2 of the lateral convex part 32 to the fin spacing S is 0.35~0.4.

In some embodiments, the fin base 10 is provided with an annular groove 40, the tube hole 20 is located in the annular groove 40, the annular groove 40 and the tube hole 20 are disposed concentrically, an outer circumference of the annular groove 40 is connected to the first plate 11 and the second plate 12, and the convex parts 30 are all located outside the annular groove 40. The structural arrangement of the annular groove 40 is convenient for stamping and forming of the peripheral lateral convex parts 32 and annular convex parts 31, which improves process practicality. Due to the structure of the annular groove 40, the processing difficulty is simplified, the processing cost of the fin structure is reduced, and a very high industrial value is achieved.

There are two second plates 12 between two first plates 11, the two second plates 12 are disposed adjacent to each other, and a wave trough line 13 is formed on which the two second plates 12 intersect. An arc-shaped surface 41 is formed at a joint between the annular groove 40 and each first plate 11. Two planes 42 are formed at joints between the annular groove 40 and each second plate 12. The two arc-shaped surfaces formed at the joints between the annular groove 40 and two first plates 1 are symmetrical with respect to the tube hole 20. The four planes 42 formed at the joints between the annular groove 40 and two second plates 12 are symmetrical with respect to the tube hole 20. The groove bottom 43 of the annular groove 40 is a circular surface, and is tangent to the wave trough line 13 in a vertical incoming flow direction. An included angle θ between a generatrix of the arc-shaped surface 41 and a central axis of the heat exchange tube is 45°.

A ratio d1/D of a diameter d1 of the groove bottom 43 of the annular groove 40 to an outer diameter D of the heat exchange tube is 1.6~1.7. A ratio D1/D of an inner diameter D1 of the tube hole 20 to the outer diameter D of the heat exchange tube is 1.025~1.035.

The present application also provides an embodiment of a heat exchanger, and the heat exchanger includes the fin structure of the above embodiments.

The present embodiments are verified by ANSYS Fluent simulation. During the simulation, an inlet air flow rate is 2 m/s, 3 m/s, 4 m/s, 5 m/s and 6 m/s respectively, an air inlet temperature is 35° C., a tube wall temperature is 50.62° C., change conditions of a heat exchange amount Q, a Nusselt number Nu and a thermal resistance R as well as flow field characteristics in a flow channel before and after the lateral convex parts 32 and the annular convex parts 31 are disposed in the case of the same flow are compared, wherein the heat exchange amount Q, Nusselt number Nu, and thermal resistance R are defined as follows:

$$Q=mC_p(T_{out}-T_{in})$$

m is a mass flow, and its unit is kg/s; Cp is a constant pressure specific heat capacity, and its unit is j/(kg·K); $T_{out}$ is an outlet average temperature of an air flow channel, and its unit is K; and $T_{in}$ is an inlet average temperature of the air flow channel, and its unit is K.

$$Nu = \frac{hD_e}{\lambda}$$

h is a convective heat transfer coefficient, and its unit is w/(m$^2$·K); De is an equivalent diameter of an air flow surface, and its unit is m; and λ is an air thermal conductivity coefficient, and its unit is w/(m·K).

$$h = \frac{Q}{S\Delta T_m}$$

S is a heat transfer surface area of the fin, and its unit is m$^2$; and ΔTm is a logarithmic average temperature difference and its unit is K.

$$\Delta T_m = \frac{\Delta T_{max} - \Delta T_{min}}{\ln\frac{\Delta T_{max}}{\Delta T_{min}}}$$

$$\Delta T_{max} = T_{wall} - T_{in}$$

$$\Delta T_{min} = T_{wall} - T_{out}$$

Twall is an average temperature of the fin surface and its unit is K.

$$R = \frac{\Delta T_m}{Q}$$

The heat exchange amount Q, Nusselt number Nu, and thermal resistance R may all be calculated by extracting simulation data, and the larger the heat exchange amount Q and the Nusselt number Nu are, or the smaller the thermal resistance R is, the better the heat exchange performance is.

Figure 5:
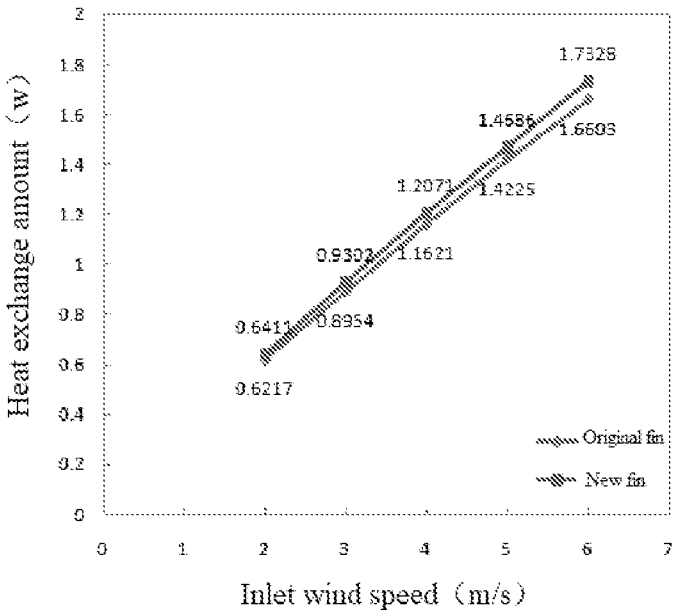
FIG. 5 is a data comparison diagram of a change condition of a heat exchange amount Q with an inlet wind speed.

The change condition of the heat exchange amount Q with an inlet wind speed is shown by FIG. 5. As the inlet wind speed increases, the increase of the heat exchange amount is improved. At 6 m/s, the increase of the heat exchange amount is the largest compared with the original fin and is 4.37%. The new fin in FIG. 5 refers to the fin structure according to the present application, and the original fin refers to a fin structure of the prior art.

Figure 6:
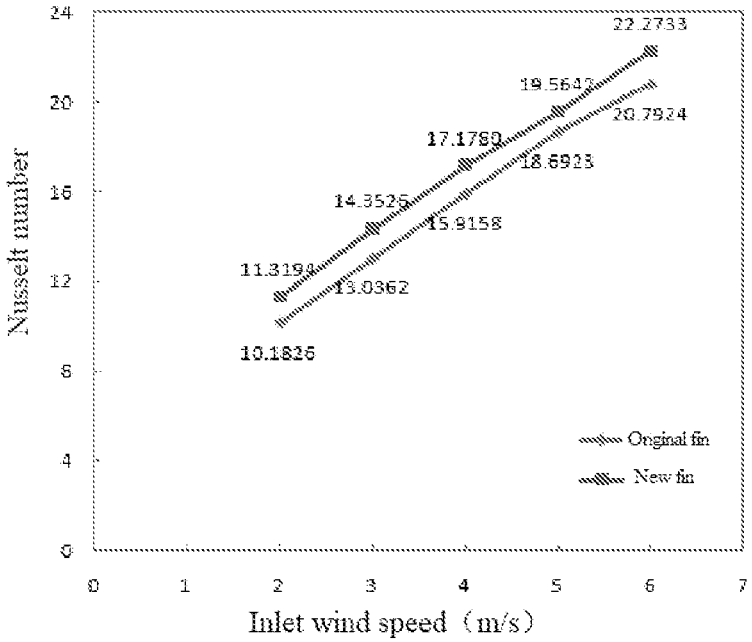
FIG. 6 is a data comparison diagram of a change condition of a Nusselt number Nu with the inlet wind speed.

The change condition of the Nusselt number Nu with the inlet wind speed is shown by FIG. 6. As the inlet wind speed increases, the Nusselt number gradually increases. At 2 m/s, the increase of the Nusselt number is the largest compared with the original fin and is 11.16%. The new fin in FIG. 6 refers to the fin structure according to the present application, and the original fin refers to the fin structure of the prior art.

Figure 7:
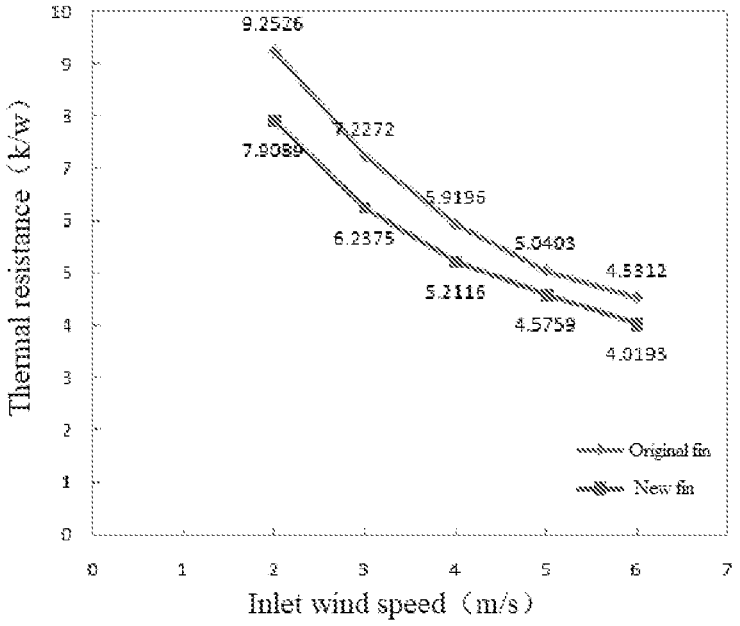
FIG. 7 is a data comparison diagram of a change condition of a thermal resistance R with the inlet wind speed.

The change condition of the thermal resistance R with the inlet wind speed is shown by FIG. 7. As the inlet wind speed increases, the thermal resistance gradually decreases. At 2 m/s, the decrease of the thermal resistance is the largest compared with the original fin, and is 14.52%. The new fin in FIG. 7 refers to the fin structure according to the present application, and the original fin refers to the fin structure of the prior art.

Figure 8:
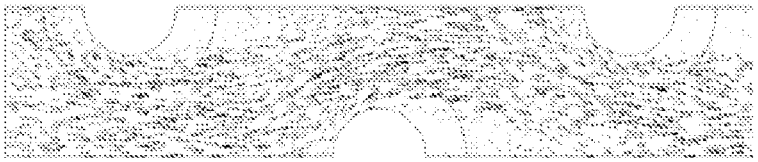
FIG. 8 is a schematic comparison diagram of flow field characteristics in a flow channel when the inlet wind speed is 2 m/s.
Figure 8:
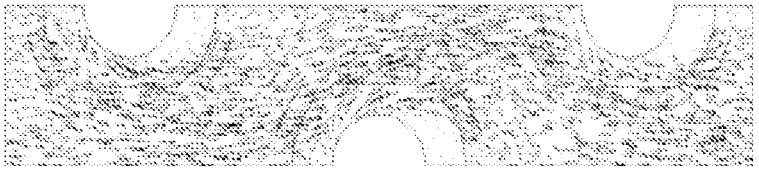
Figure 9:
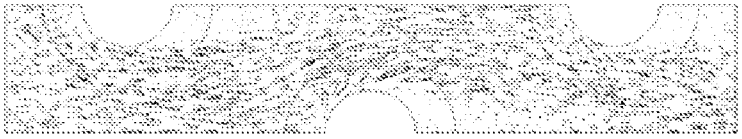
FIG. 9 is a schematic comparison diagram of flow field characteristics in a flow channel when the inlet wind speed is 4 m/s.
Figure 9:
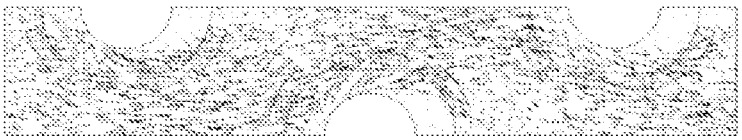
Figure 10:
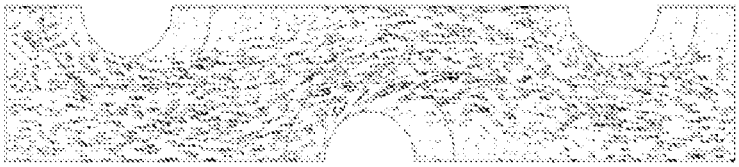
FIG. 10 is a schematic comparison diagram of flow field characteristics in a flow channel when the inlet wind speed is 6 m/s.
Figure 10:
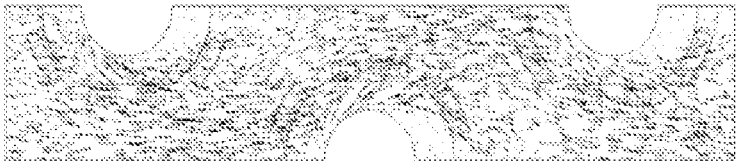
Figure 11:
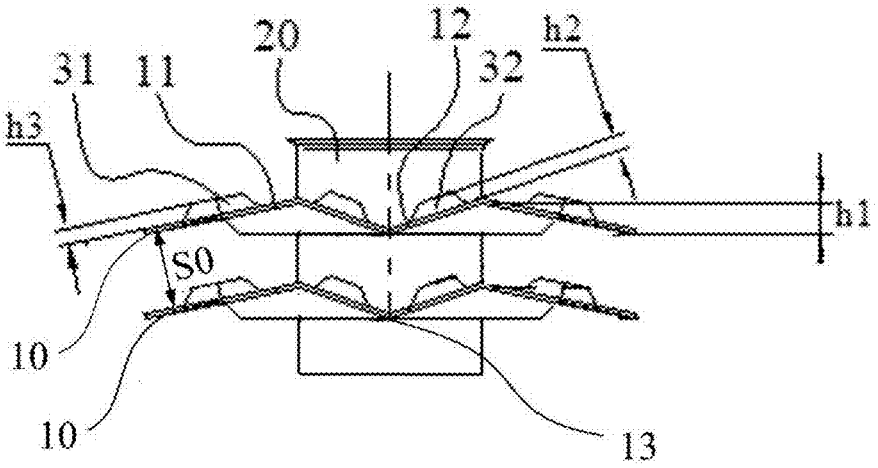
FIG. 11 is a sectional view of a heat exchanger according to an embodiment of the present application.

The present application also provides comparison conditions of the flow field characteristics in the flow channel before and after the lateral convex parts 32 and the annular convex parts 31 are disposed when the inlet wind speed is 2 m/s, 4 m/s and 6 m/s, as shown in FIGS. 8-10. FIG. 8 shows the comparison condition of the flow field characteristics in the flow channel when the inlet wind speed is 2 m/s; FIG. 9 shows the comparison condition of the flow field characteristics in the flow channel when the inlet wind speed is 4 m/s; and FIG. 10 shows the comparison condition of the flow field characteristics in the flow channel when the inlet wind speed is 6 m/s.

At different inlet wind speeds, the comparison between the fin structure of the prior art and the fin structure of the present application shows the same difference in the flow field characteristics, which mainly reflects that due to the arrangement of the lateral convex parts 32 and the annular convex parts 31, the airflow disturbance nearby the heat exchange tube is enhanced, so that the flow rate in the local area is increased, the mixing of cold and hot fluids is enhanced, and the thickness of the boundary layer is reduced, which significantly reduces a wake area behind the tube, and increases the effective heat exchange area of the fin, thereby enhancing the heat exchange performance of the heat exchanger.

It should be noted that the terms used herein are merely for the purpose of describing specific embodiments, and are not intended to limit exemplary embodiments according to the present application. As used herein, unless the context clearly indicates, otherwise, the singular is intended to include the plural. In addition, it should also be understood that when the term "containing" and/or "including" is used in the description, it indicates the existence of features, steps, works, devices, components and/or combinations thereof.

It should be noted that the terms "first", "second", etc., in the description, claims and the above drawings of the present application are used to distinguish similar objects, and are not necessarily used to describe a specific order or sequence. It is to be understood that the data used as such can be interchanged under appropriate circumstances, so that the embodiments of the application described herein can be implemented in sequences other than those illustrated or described herein.

Of course, the above are the preferred embodiments of the present application. It should be pointed out that for those skilled in the art, without departing from basic principles of the present application, several improvements and modifications can also be made, and these improvements and modifications are also regarded as the protection scope of the present application.

The invention claimed is:

1. A fin structure, comprising:

a fin base, wherein the fin base is provided with a tube hole for a heat exchange tube to passthrough, and the fin base is a corrugated fin; and a plurality of convex parts, wherein the plurality of convex parts are disposed on the fin base, and the plurality of convex parts surround an outer circumference of the tube hole;

wherein the fin base comprises a plurality of first fin portions and a plurality of second fin portions, at least two of the plurality of second fin portions connected between two of the plurality of first fin portions, a dimension L1 of any one of the first fin portions along the corrugation length direction of the fin base is greater than a dimension L2 of any one of the second fin portions along the corrugation length direction of the fin base;

wherein the plurality of convex parts comprise an annular convex part and a lateral convex part, the annular convex part being convexly disposed on the one of the plurality of first fin portions, the lateral convex part being convexly disposed on the one of the plurality of second fin portions.

2. The fin structure according to claim 1, comprising two of the plurality of second fin portions connected between two of the plurality of first fin portions, and wherein the two second fin portions are disposed adjacently.

3. The fin structure according to claim 1, wherein the annular convex part is an annular convex structure, a plurality of the annular convex parts are disposed, and the plurality of the annular convex parts are symmetrically distributed on the outer circumference of the tube hole.

4. The fin structure according to claim 1, wherein the lateral convex part is a boss, a plurality of the lateral convex parts are disposed, and the plurality of the lateral convex parts are symmetrically distributed on the outer circumference of the tube hole.

5. The fin structure according to claim 1, wherein the fin base is provided with:

an annular groove, wherein the tube hole is located in the annular groove, the annular groove and the tube hole are concentrically disposed, an outer circumference of the annular groove is connected to one of the plurality of the first fin portions and one of the plurality of the second fin portions, and the convex parts are all located outside the annular groove.

6. The fin structure according to claim 5, wherein, there are two of the plurality of second fin portions between two of the plurality of first fin portions, the two second fin portions are disposed adjacently, and a wave trough line is formed on which the two second fin portions intersect; and two arc-shaped surfaces symmetrical with respect to the tube hole are formed at joints between the annular groove and the two first fin portions, and four planes symmetrical with respect to the tube hole are formed at joints between the annular groove and the two second fin portions.

7. The fin structure according to claim 6, wherein, a groove bottom of the annular groove is tangent to the wave trough line in a vertical incoming flow direction; and an included angle θ between a generatrix of the arc-shaped surface and a central axis of the heat exchange tube is 45°.

8. The fin structure according to claim 5, wherein a ratio d1/D of a diameter d1 of the groove bottom of the annular groove to an outer diameter D of the heat exchange tube is 1.6~1.7.

9. The fin structure according to claim 2, wherein the two first fin portions are symmetrically disposed with respect to the tube hole, and the two second fin portions are symmetrically disposed with respect to the tube hole.

10. The fin structure according to claim 1, wherein a ratio D1/D of an inner diameter D1 of the tube hole to an outer diameter D of the heat exchange tube is 1.025~1.035.

11. A heat exchanger, comprising the fin structure according to claim 1.

12. The heat exchanger according to claim 11, comprising a plurality of the fin structures, wherein, the fin base comprises a plurality of first fin portions and a plurality of second fin portions, at least two of the plurality of second fin portions connected between two of the plurality of first fin portions, a dimension L1 of any one of the first fin portions along the corrugation length direction of the fin base is greater than a dimension L2 of any one of the second fin portions along the corrugation length direction of the fin base;

a ratio h1/S0 of a corrugation height h1 of the fin base to a fin spacing S0 is 0.58~0.62, and L1/L2 is 1.5~1.7.

13. The heat exchanger according to claim 11, comprising a plurality of the fin structures, wherein, the fin base comprises a plurality of first fin portions and a plurality of second fin portions, at least two of the plurality of second fin portions connected between two of the plurality of first fin portions, a dimension L1 of any one of the first fin portions along the corrugation length direction of the fin base is greater than a dimension L2 of any one of the second fin portions along the corrugation length direction of the fin base;

the plurality of convex parts comprise an annular convex part, the annular convex part being convexly disposed on the first fin portion; and a ratio h3/S0 of a raised height h3 of the annular convex part to the fin spacing S0 is 0.35~0.4.

14. The heat exchanger according to claim 11, comprising a plurality of the fin structures, wherein, the fin base comprises a plurality of first fin portions and a plurality of second fin portions, at least two of the plurality of second fin portions connected between two of the plurality of first fin portions, a dimension L1 of any one of the first fin portions along the corrugation length direction of the fin base is greater than a dimension L2 of any one of the second fin portions along the corrugation length direction of the fin base;

the plurality of convex parts comprise a lateral convex part, the lateral convex part being convexly disposed on the second fin portion; and a ratio h2/S0 of a raised height h2 of the lateral convex part to the fin spacing S0 is 0.35~0.4.

* * * * *